US007673962B2

(12) United States Patent
Lee

(10) Patent No.: US 7,673,962 B2
(45) Date of Patent: Mar. 9, 2010

(54) DRIVING MODULE UTILIZED FOR DRIVING A PRINT HEAD MAINTENANCE STATION

(75) Inventor: Chi-Chun Lee, Yun-Lin Hsien (TW)

(73) Assignee: Lite-On Technology Corp., Taipei (TW)

( * ) Notice: Subject to any disclaimer, the term of this patent is extended or adjusted under 35 U.S.C. 154(b) by 641 days.

(21) Appl. No.: 11/566,238

(22) Filed: Dec. 4, 2006

(65) Prior Publication Data

US 2007/0222813 A1 Sep. 27, 2007

(30) Foreign Application Priority Data

Mar. 21, 2006 (TW) ..... 95109714 A

(51) Int. Cl.
*B41J 2/165* (2006.01)

(52) U.S. Cl. ..... 347/22; 347/29; 347/33

(58) Field of Classification Search ..... 347/22, 347/29, 32, 33, 23

See application file for complete search history.

(56) References Cited

U.S. PATENT DOCUMENTS 6,220,692 B1 * 4/2001 Iwaya et al. ..... 347/33
6,447,094 B1 * 9/2002 Berg et al. ..... 347/22
7,175,253 B2 * 2/2007 Lee et al. ..... 347/32

* cited by examiner

*Primary Examiner*—Shih-Wen Hsieh
(74) *Attorney, Agent, or Firm*—Rosenberg, Klein & Lee

(57) ABSTRACT

A driving module utilized for driving a print head maintenance station. The print head maintenance station includes a capper and a wiper. The driving module includes: a first rotation unit having a first surface corresponding to a first profile; a second rotation unit having a second surface corresponding to a second profile; a first connection module for moving the capper according to the first profile of the first rotation unit; a second connection module for moving the wiper according to the second profile of the second rotation unit; a transfer module coupled to the first connection module and the second connection module; and a motor coupled to the transfer module for driving the first and second rotation units to rotate simultaneously according to the transfer module.

10 Claims, 10 Drawing Sheets

DRIVING MODULE UTILIZED FOR DRIVING A PRINT HEAD MAINTENANCE STATION

BACKGROUND OF THE INVENTION

1. Field of the Invention

The present invention relates to a driving module utilized for driving a print head maintenance station, and more particularly, to a driving module for driving a print head maintenance station according to only a signal power source.

2. Description of the Prior Art

In part because of the high printing quality and the reasonable price to the consumer, ink jet printers have become one of the most popular pieces of print equipment in the market. In order to continue to conform to the high quality performance expectations of the users, the common ink jet printer usually includes a print head maintenance station to clean and maintain the print head. The print head maintenance therefore prevents from the ink from being clogged in the print head and makes sure the print head can be operated correctly with high quality.

Generally, the main components of the print head maintenance station are a wiper and a capper. The primary function of the wiper is utilized to scrape the ink residue from the print head while the primary function of the capper is utilized for covering the print head, when the print head moves back to its original position, to prevent the ink residue dry on the print head from clogging the nozzle of the print head. Normally, during the print process, the print head maintenance station will utilize the wiper and the capper move respectively to the print head to achieve the purpose of clean and maintenance of the print head. In the conventional print head maintenance station, the power sources (e.g., a motor) of the wiper and capper are separated. That is, when the conventional print head maintenance station performs the operation of cleaning the print head, two motors are needed to drive the wiper and the capper respectively. Moreover, the print head maintenance station further includes other components, such as the scraper and the pump, therefore the print head maintenance station needs more power sources (e.g., more motors) to drive all of the components. This manner not only increases the design cost of the ink jet printer and the power consumption, but also causes the waste of valuable space because of the need for these additional motors. That is, the ink jet printer in the prior art does not conform to the trend of space minimization, high efficiency, and low cost that is in high demand by today's modern society.

SUMMARY OF THE INVENTION

It is therefore an objective of the claimed invention to provide a driving module for driving a print head maintenance station according to only a signal power source, to solve the above-mentioned problems.

According to an embodiment of the present invention, a driving module for driving a print head maintenance station is disclosed. The print head maintenance station includes a capper and a wiper. The driving module comprises a first rotating unit, a second rotating unit, a first supportive component, a second supportive component, a transfer module and a motor. The first rotating unit contains a first profile; the second rotating unit contains a second profile; the first supportive component is coupled to the first rotating unit and the capper for driving the capper according to the first profile of the first rotating unit; the second supportive component is coupled to the second rotating unit and the wiper for driving the wiper according to the second profile of the second rotating unit; the transfer module is coupled to the first, and second rotating unit; and the motor is coupled to the transfer module for providing a single power source to drive the first, and second rotating unit simultaneously to rotate through the transfer module.

According to another embodiment of the present invention, a printing device is disclosed. The printing device includes a printing control unit; a print head maintenance station; and a driving module.

The print head maintenance station comprises a capper and a wiper. The driving module comprises; a first rotating unit containing a first profile; a second rotating unit containing a second profile; a first supportive component coupled to the first rotating unit and the capper for driving the capper according to the first profile of the first rotating unit; a second supportive component coupled to the second rotating unit and the wiper for driving the wiper according to the second profile of the second rotating unit; a motor; and a transfer module for selectively coupling the motor to the first rotating unit, the second rotating unit or the print control unit, wherein when the motor is coupled to the first rotating unit and the second rotating unit, the motor drives the first, and second rotating unit simultaneously to rotate through the transfer module, and when the motor is coupled to the print control unit, the motor drives the print control unit to rotate through the transfer module.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, consumer electronic equipment manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." The terms "couple" and "couples" are intended to mean either an indirect or a direct electrical connection. Thus, if a first device couples to a second device, that connection may be through a direct connection, or through an indirect connection via other devices.

Figure 1:
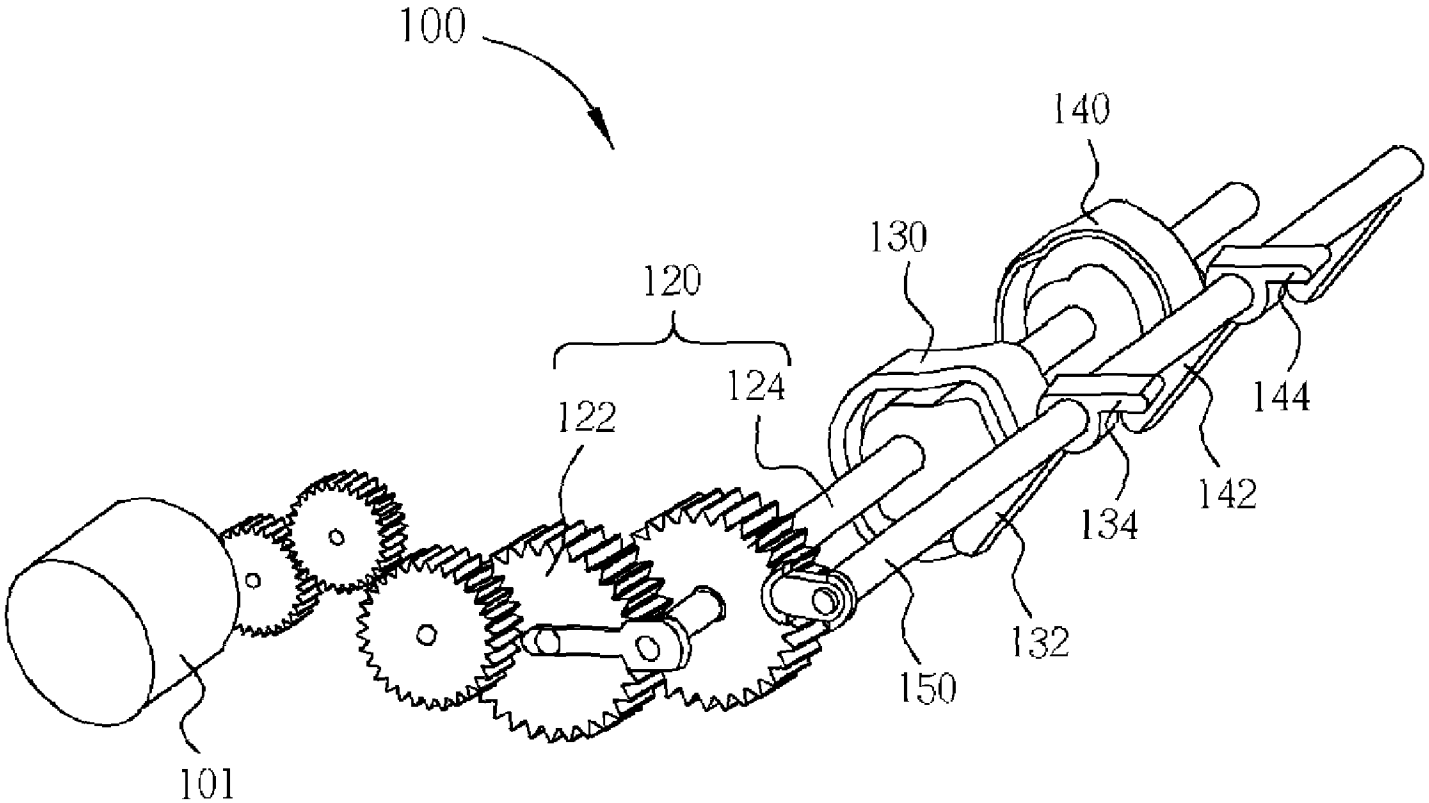
FIG. 1 is a diagram illustrating the three dimensional structure of the driving module according to a first embodiment of the present invention.
Figure 2:
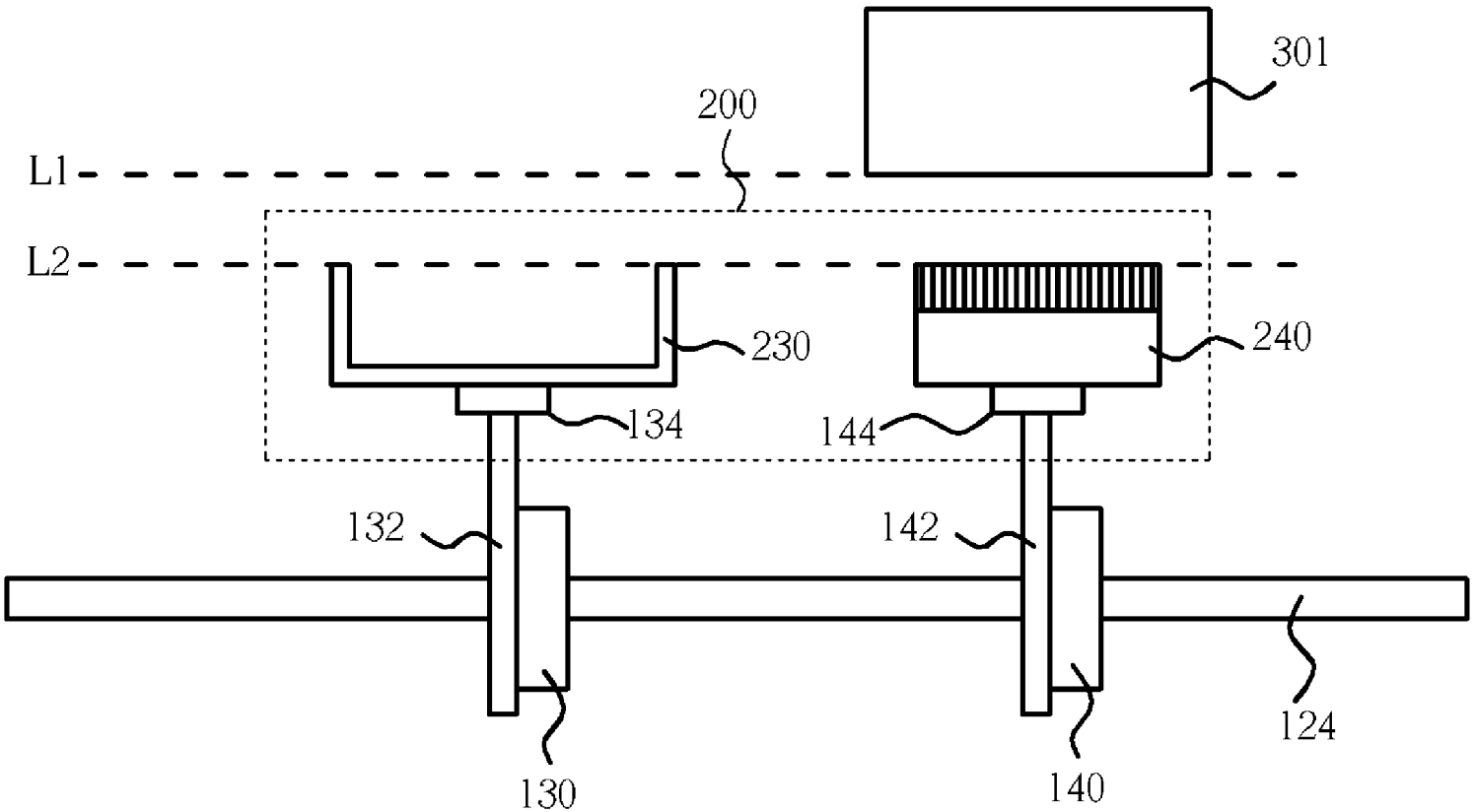
FIG. 2 is a schematic diagram illustrating the driving module shown in FIG. 1 driving the print head maintenance station of the present invention.

Please refer to FIG. 1 and FIG. 2, FIG. 1 is a diagram illustrating the three dimensional structure of the driving module 100 according to a first embodiment of the present invention. FIG. 2 is a schematic diagram illustrating the driving module 100 shown in FIG. 1 driving the print head maintenance station 200 of the present invention. The driving module 100 includes a transfer module 120, a plurality of cams 130 and 140, a plurality of levers 132 and 142, a plurality of supportive components 134 and 144, and a fixed shaft 150. The transfer module 120 includes a gear set 122, a shaft 124, and a print head maintenance station 200. In this embodiment, the print head maintenance station 200 is applied as a maintenance device of an inkjet print head. The print head maintenance station 200 includes a capper 230 and a wiper 240. Moreover, the combination set of the lever 132, 142 and the supportive component 134, 144 is functioned as a connection module for driving the capper 230 and the wiper 240. As shown in FIG. 1, the motor 101 provides the required power source of the driving module 100 according to a specific rotation direction (e.g., a clockwise or a counter-clockwise direction). Then the gear set 122 of the transfer module 120 drives the power source provided by the motor 101 into the shaft 124. Next, the cams 130 and 140, which are fixed on the shaft 124, rotate according to the rotating direction of the shaft 124. Additionally, the levers 132 and 142 are coupled to the cams 130 and 140 respectively, and perform the vertical or horizontal motion according to the profiles of the cams 130 and 140 respectively. The detail operation of the levers 132 and 142 will be address later in the present disclosure. Next, according to the displacement of the levers 132 and 142, the supportive components 134 and 144 then drive the capper 230 and the wiper 240 respectively, which are fixed on the supportive components 134 and 144, to perform the vertical or horizontal motion, and further to achieve the purpose of cleaning and protecting the print head 301.

As shown in FIG. 2, the capper 230 and the wiper 240 are moved up or down respectively according to the driving of the supportive components 134 and 144. Please note that, the wiper 240 and the capper 230 of the print head maintenance station 200 are moved separated and usually not simultaneously when perform the cleaning operation. For example, when the wiper 240 is moved up to touch the print head 301 (i.e., the high position L1 in FIG. 2) to clean the print head 301, it is not necessary for the capper 230 to move up or down; otherwise, when the print head is in a stopped situation (e.g., turned off condition), the capper 230 then can be moved up to touch the print head 301 (i.e., the high position L1 in FIG. 2) to protect the print head 301, and at this time the wiper 240 should move away the print head (i.e., the low position L2 in FIG. 2) to make the print head 301 move to the upper position of the capper 230. Note how these operations are conveniently executed. Therefore, in the present invention, the driving module 100 utilizes the different curvature radius of the profiles of the cams 130 and 140 to drive the cappers 230 and 240 to complete the different operations as described herein. That is, this embodiment in the present invention can control the capper 230 and wiper 240 to move up or down according to the design of the curvature radius of the profiles of the cams 130 and 140. Therefore, according to the proper design of the profiles of the cams 130 and 140, the moving timing of the cappers 230 and wiper 240 can be decided (i.e., defined as required by the needs at hand).

Figure 3:
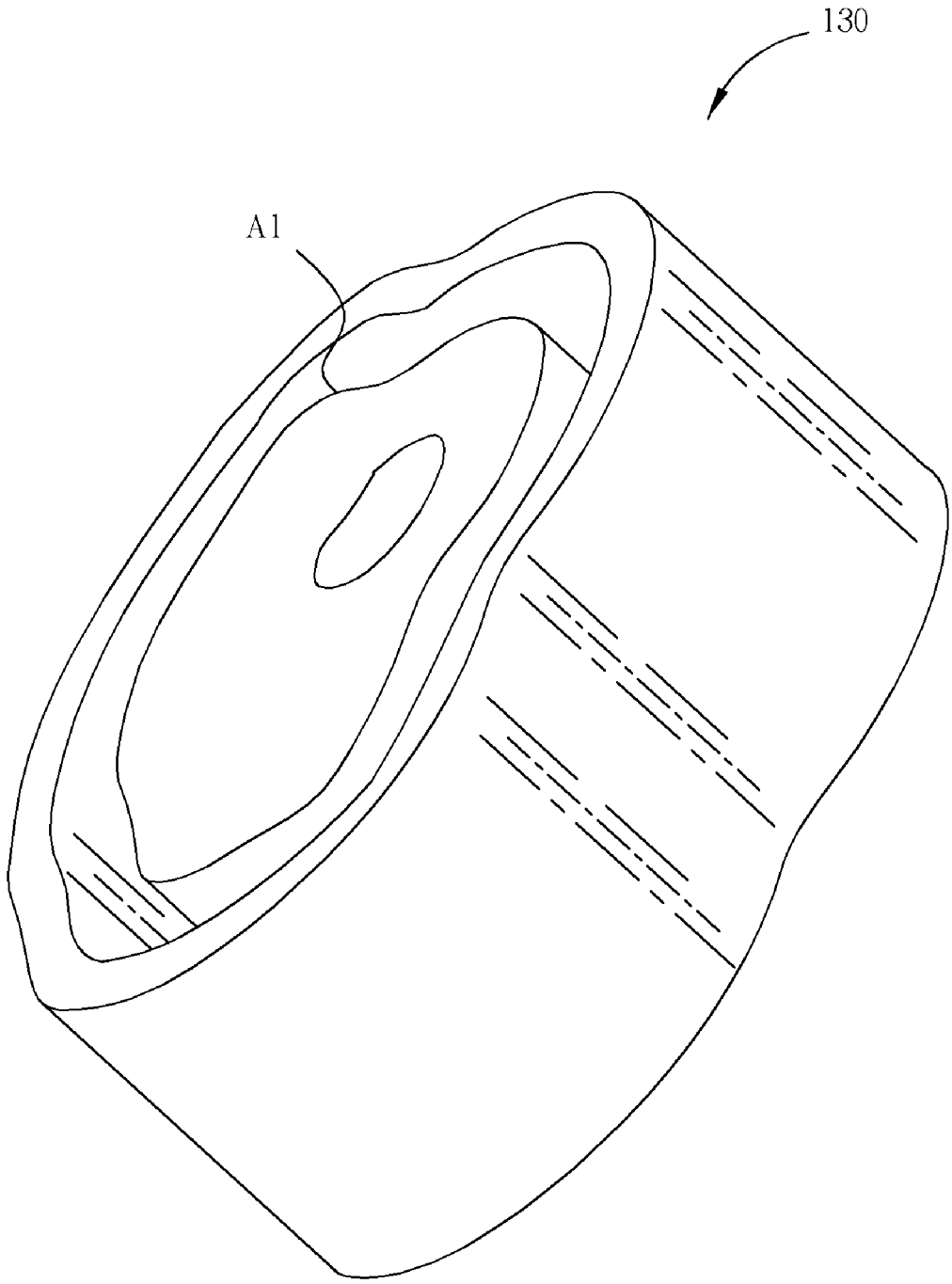
FIG. 3 is a diagram illustrating the three dimensional structure of an embodiment of the cam shown in FIG. 1 of the present invention.
Figure 4:
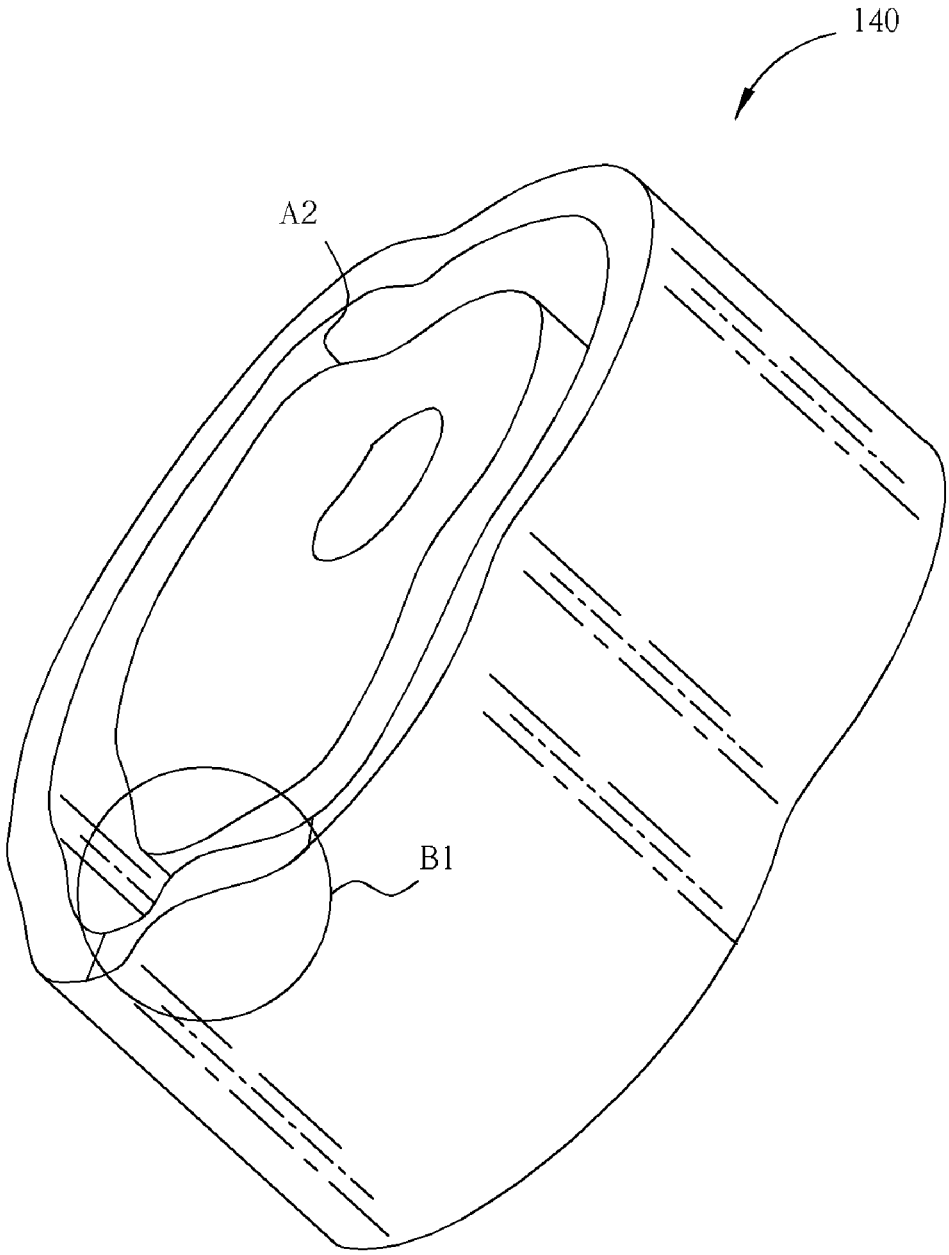
FIG. 4 is a diagram illustrating the three dimensional structure of a first embodiment of the cam shown in FIG. 1 of the present invention.
Figure 5:
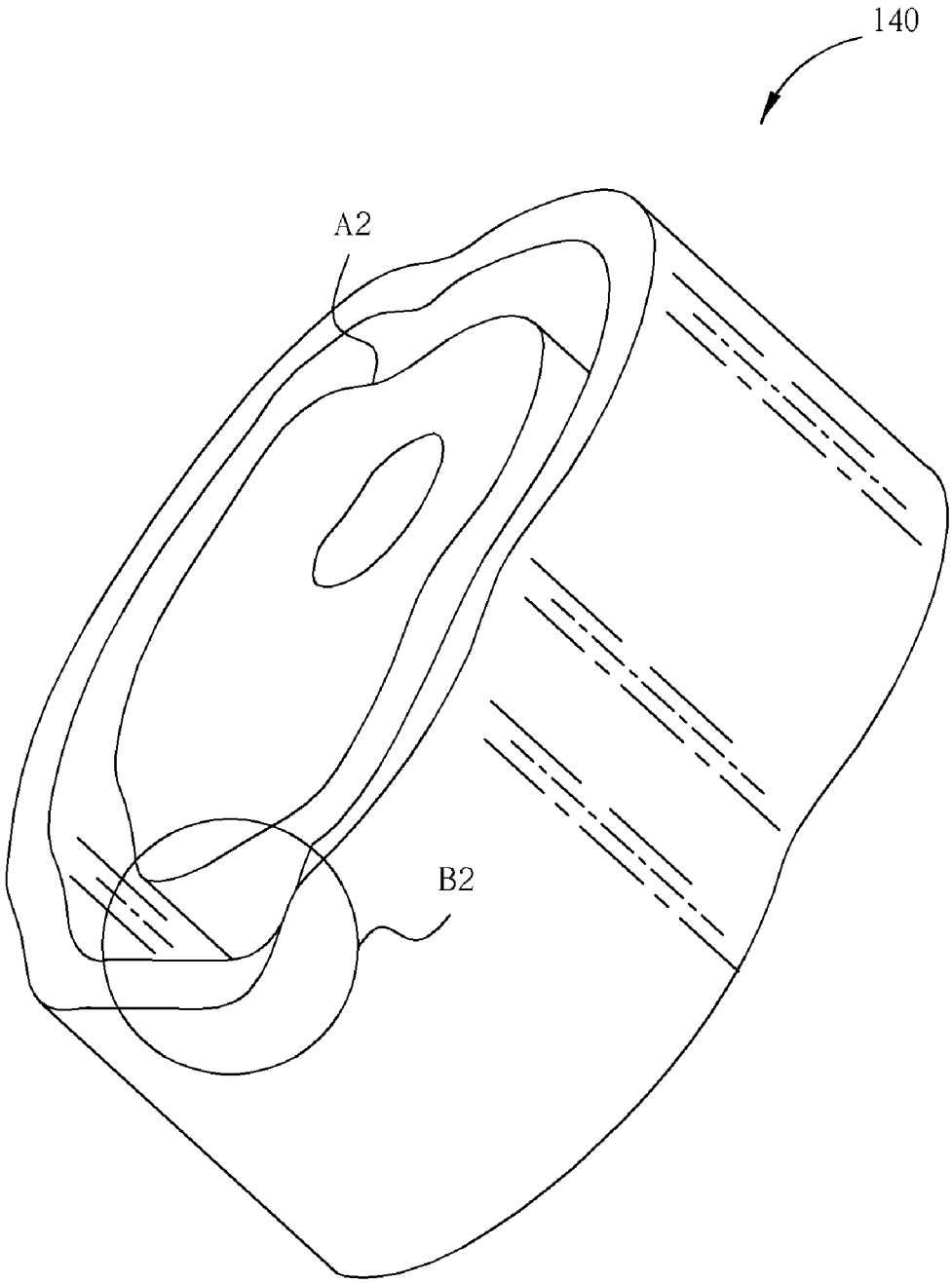
FIG. 5 is a diagram illustrating the three dimensional structure of a second embodiment of the cam shown in FIG. 1 of the present invention.

Please refer to FIG. 3, FIG. 4, and FIG. 5 at the same time. FIG. 3 is a diagram illustrating the three dimensional structure of an embodiment of the cam 130 shown in FIG. 1. FIG. 4 is a diagram illustrating the three dimensional structure of a first embodiment of the cam 140 shown in FIG. 1. FIG. 5 is a diagram illustrating the three dimensional structure of a second embodiment of the cam 140 shown in FIG. 1. As shown in FIG. 3, FIG. 4 and FIG. 5, the cams 130 or 140 have different profile designs (e.g., A1 and A2 shown in FIG. 4 and FIG. 5) according to what device to drive. In the present invention, the profiles of the cams 130 and 140 are designed according to the capper 230 and the wiper 240 of the print head maintenance station 200. In the present invention, to drive the supportive components 134 and 144 on the levers 132 and 142 to move up or down the levers 132 and 142 will change the distance between the canter of shaft 124 and levers 132 or 142 according to the different profiles of the cams 130 and 140. That is, the capper 230 and the wiper 240, which are fixed on the supportive components 134 and 144 respectively, then can perform the different cleaning operations according to the different profiles of the cams 130 and 140. For the cam 140, the profile A2 is set on the radius direction surface of the cam 140; and a protruding part B1 or a concave part B2 is set on the shaft direction surface of the cam 140. Therefore, when the end of the lever 142 which is moved on the profile A2 is touched to the protrude part B1 (as shown in FIG. 4) or the concave part B2 (as shown in FIG. 5) of the cam 140, the lever 142 can be moved in the horizon direction to drive the wiper 240 to move left or to move right.

Figure 6:
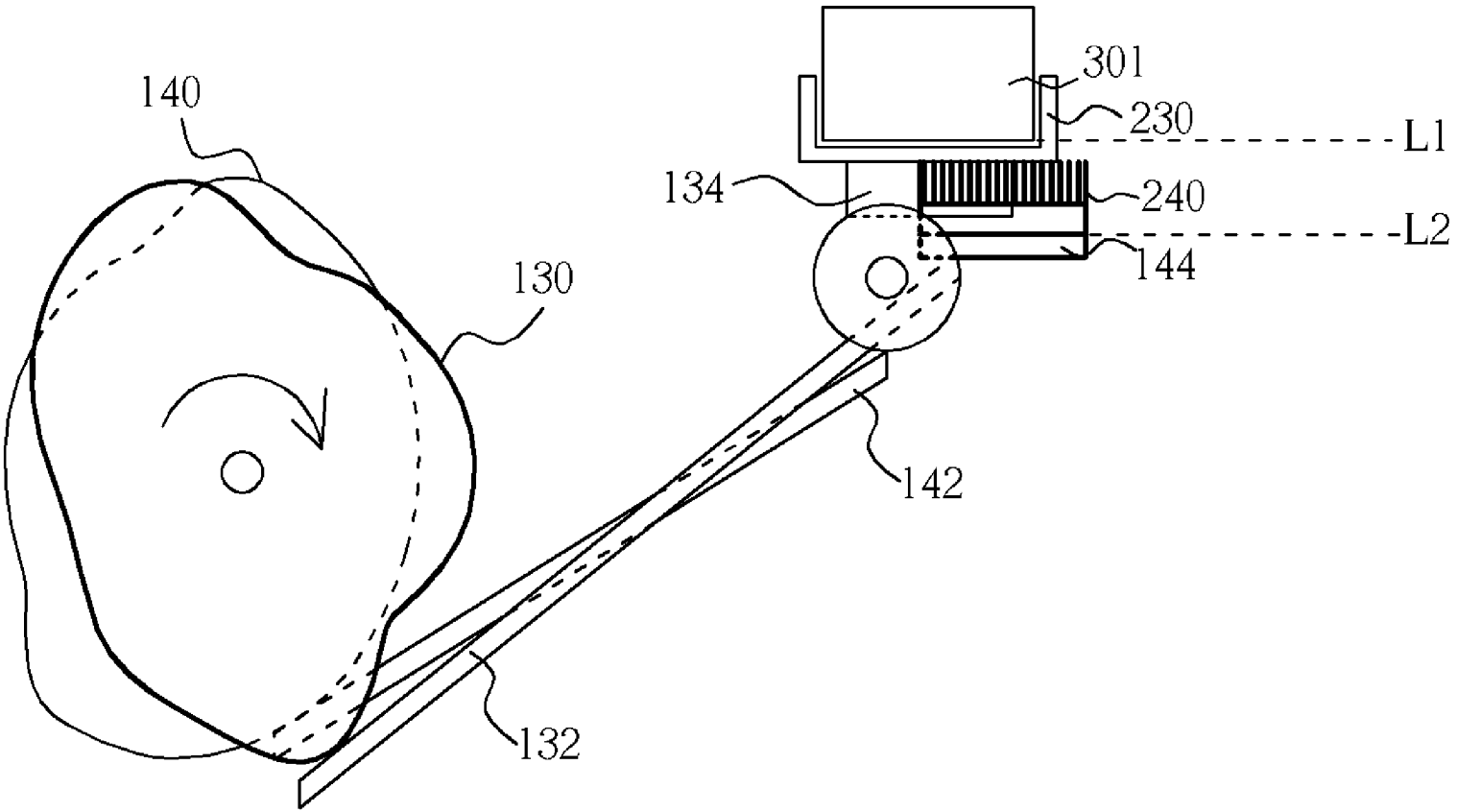
FIG. 6 is a schematic diagram illustrating the driving module shown in FIG. 1 in a first situation of the present invention.
Figure 7:
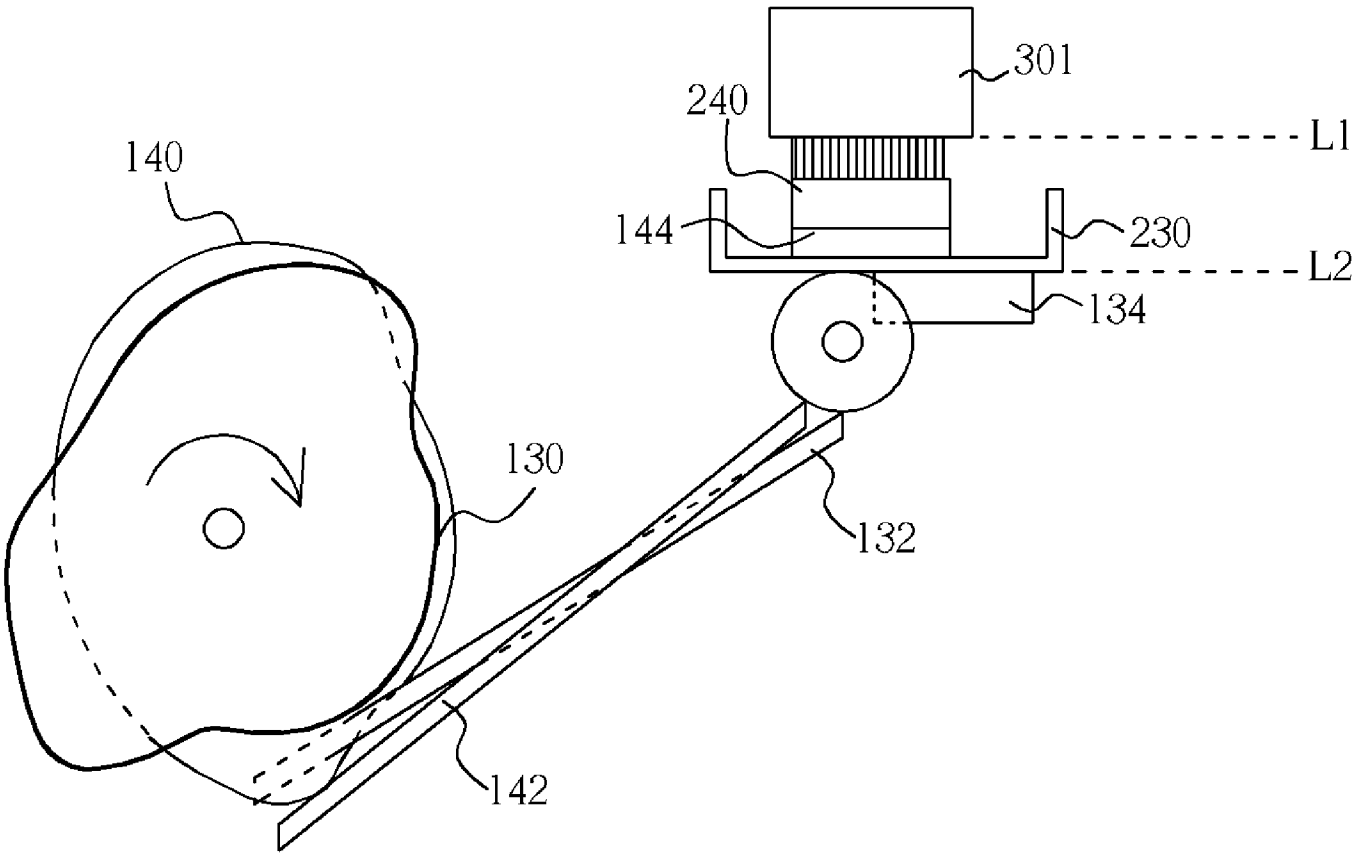
FIG. 7 is a schematic diagram illustrating the driving module shown in FIG. 1 in a second situation of the present invention.

For a more detailed description of the operation of the cams 130 and 140, please refer to FIG. 6. FIG. 6 is a schematic diagram illustrating the driving module 100 shown in FIG. 1 in a first situation. Assuming that the capper 230 is located in a high position L1 and the wiper 240 is located in a low position L2 during a specific timing (e.g., in the turning off situation), then the motor 101 drives the shaft 124 to rotate at a specific rotating angle (e.g., zero degree). At this time the touch position of the lever 132 and the cams 130 is different from the touch position of the lever 142 and the cam 132. As shown in FIG. 6, the distance between the bottom of the lever 132 and the shaft 124 is larger than the distance between the bottom of the lever 142 and the shaft 124. In this situation, the supportive component 134 is moved up and thereby drives the capper 230 to move up to the high position L1 to cover the print head 301. Additionally, please refer to FIG. 7. FIG. 7 is a schematic diagram illustrating the driving module 100 shown in FIG. 1 in a second situation. Assuming that the wiper 240 is located in a high position L1 and the capper 230 is located in a low position L2 during a specific timing (e.g., perhaps in a cleaning situation), then the motor 101 drives the shaft 124 to rotate at a specific rotating angle (e.g., 75 degrees). At this time the touch position of the lever 132 and the cams 130 is different from the touch position of the lever 142 and the cam 132. As shown in FIG. 7, the distance between the bottom of the lever 142 and the shaft 124 is larger than the distance between the bottom of the lever 132 and the shaft 124. In this situation, the supportive component 144 is moved up and thereby drives the wiper 240 to move up to the high position L1. Meanwhile, as mentioned above, the cam 140 has a protruding part B1 or a concave part B2. Therefore, when the wiper 240 is touched by the print head 301, the continuous rotating of the cam 140 makes the lever 142 touch the protrude part B1 or the concave part B2 and then drive the wiper 240 to move left or to move right to clean the print head 301.

Figure 8:
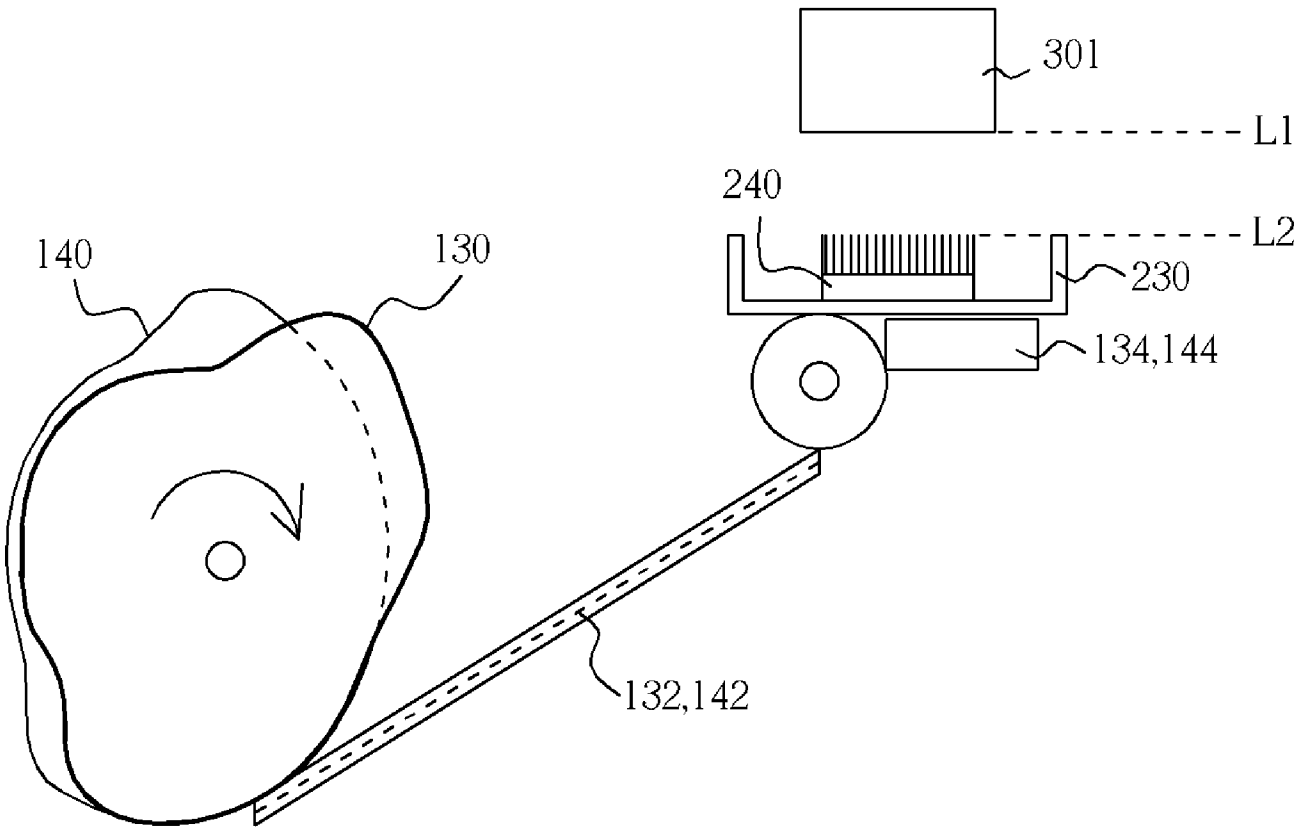
FIG. 8 is a schematic diagram illustrating the driving module shown in FIG. 1 in a third situation of the present invention.

Please refer to FIG. 8. FIG. 8 is a schematic diagram illustrating the driving module 100 shown in FIG. 1 in a third situation. As shown in FIG. 8, assuming that the capper 230 and the wiper 240 are both located at the low position L2 during a specific timing (e.g., in printing situation), then the motor 101 drives the shaft 124 to rotate at a specific rotating angle (e.g., 180 degrees). At this time the touch position of the lever 132 and the cams 130 is the same as the touch position of the lever 142 and the cam 132. That is, the distance between the bottom of the lever 142 and the shaft 124 is the same as the distance between the bottom of the lever 132 and the shaft 124. In this situation, the supportive components 134 and 142 are located at the same position (e.g., the low position L2 shown in FIG. 8). Moreover, if the motor 101 continuously drives the shaft 124 to rotate a specific angle (e.g., 270 degrees), then the capper 230 and the wiper 240 will go back to the original position. Please note that, in the above description, the capper 230 and the wiper 240 only move between the high position L1 and the low position L2. However, the driving module in the present invention is not limited in these two positions that are offered here as an example only. For example, according to the proper design of the profile of the cam 140, the wiper 240 can be located at a starting position between the high position L1 and the low position L2 during the situation of turning off (i.e., the angle of the shaft 124 is zero degrees), then the wiper 240 can be located at the high position L1 during the cleaning situation (i.e., the angle of the shaft 124 is 75 degrees), and the wiper 240 can be located at the low position L2 during the printing situation (i.e., the angle of the shaft 124 is 180 degrees). And when the angle of the shaft 124 is rotating to 270 degrees, the wiper 240 then goes back to the starting position.

Figure 9:
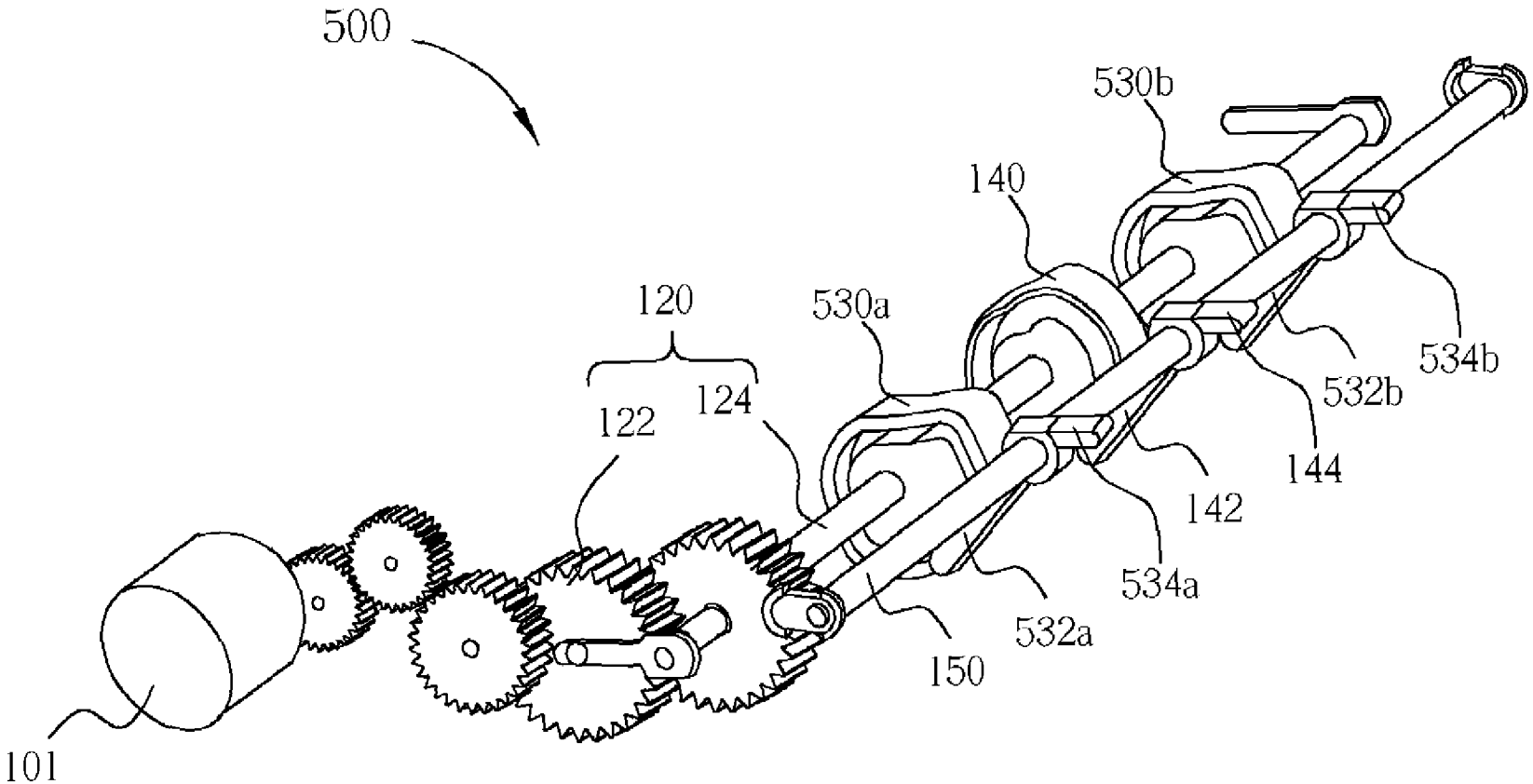
FIG. 9 is a diagram illustrating the three dimensional structure of the driving module according to a second embodiment of the present invention.

Additionally, the driving module in the present invention is not limited by the number of cams utilized for the wiper and the capper of the print head maintenance station. In other embodiments, in order to conform to the format of some long type print head that the wiper is located in the capper, the driving module in the present invention can add the number of the cam according to the different print head maintenance stations. Please refer to FIG. 9, FIG. 9 is a diagram illustrating the three dimensional structure of the driving module 500 according to a second embodiment of the present invention. In this embodiment, the driving module 500 includes a transfer module 120, a plurality of cams 530*a*, 530*b*, 140, a plurality of levers 532*a*, 532*b*, 142, a plurality of supportive components 534*a*, 534*b*, 144, and a fixed shaft 150. The transfer module 120 includes a gear set 122 and a shaft 124. The primary difference between the driving module 500 shown in FIG. 9 and the driving module 100 shown in FIG. 1 is that in the print head maintenance station of the driving module 500, the wiper is located inside the capper. Therefore, the driving module 500 utilizes two cams 530*a* and 530*b*, and two levers 532*a* and 532*b* to drive the single capper. Please note that, in this embodiment the cam 530*a* and the cam 530*b* are the same as those elements previously disclosed earlier. Therefore, the driving module 500 can follow the above-mentioned operation to drive the capper and wiper in the print head maintenance station.

Figure 10:
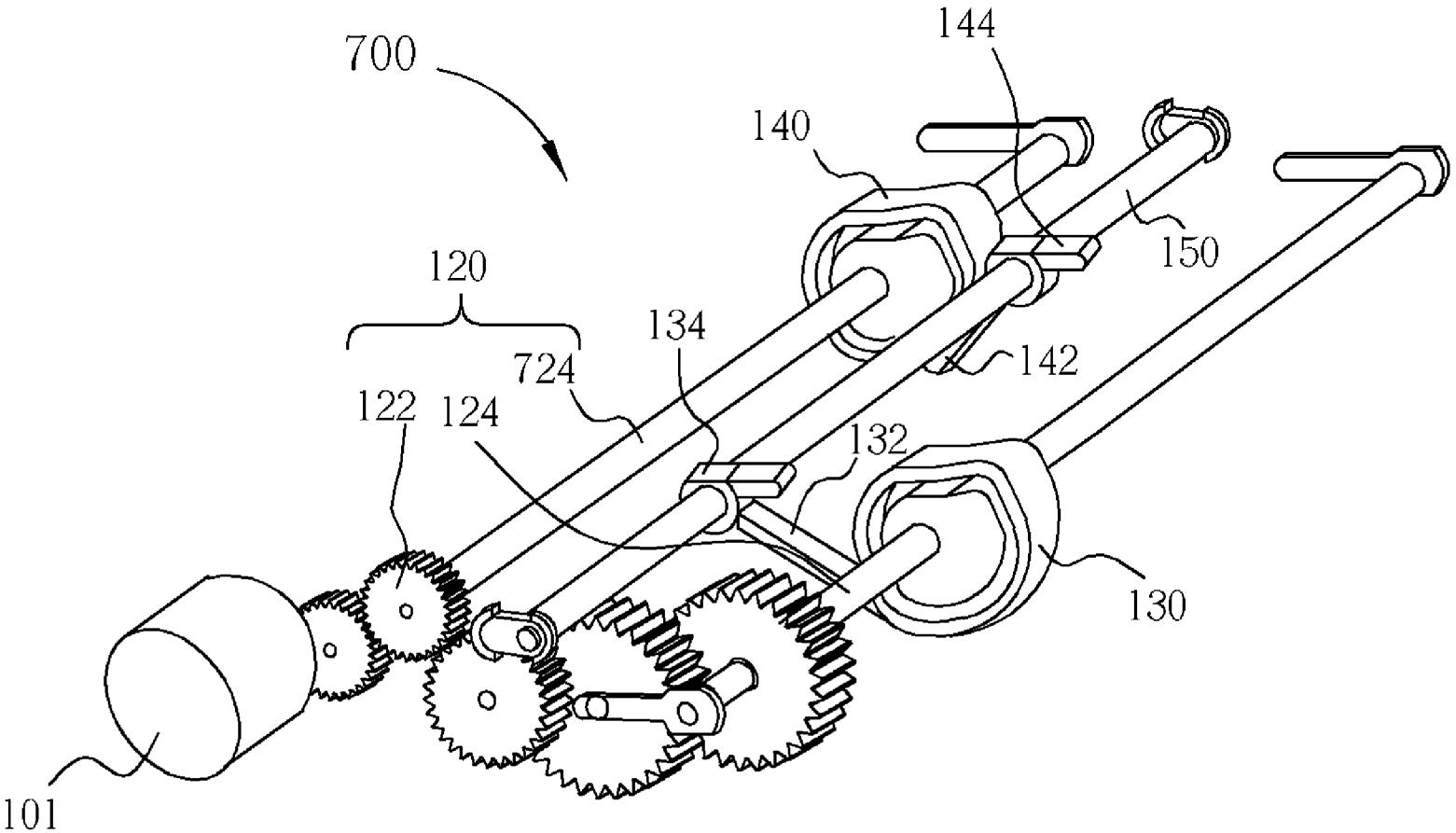
FIG. 10 is a diagram illustrating the three dimensional structure of the driving module according to a third embodiment of the present invention.

Moreover, the driving module in the present invention can put the cams corresponding capper and wiper respectively in different shafts according to the design requirements. Please refer to FIG. 10, FIG. 10 is a diagram illustrating the three dimensional structure of the driving module 500 according to a third embodiment of the present invention. In this embodiment, the driving module 700 includes a transfer module 120, a plurality of cams 130, 140, a plurality of levers 132, 142, a plurality of supportive components 134, 144, and a fixed shaft 150. The transfer module 120 includes a gear set 122 and a plurality of shafts 124 and 724. In this embodiment, the driving module 700 further adds another shaft 724 on a gear of the gear set 122, and shifts the cam 140 to the shaft 720. Although the cam 130 and the cam 140 are located at different shafts, the cams 130 and 140 are still driven by the same motor 101. That is, the above-mentioned operation also can be applied in this embodiment to drive the capper and wiper in the print head maintenance station. Please note that, the arrangement of the shafts, the gears, and the cams in the driving module 700 is just an example in the present invention disclosed herein, and are not meant to be taken as limitations.

Additionally, the driving module in the present invention is not limited to the number of devices in the print head maintenance station as disclosed herein. In other embodiments, the print head maintenance station may further include other maintenance components, such as the scrape and the pump, and the driving module in the present invention can add the cams corresponding to the scrape or the pump to drive a plurality of maintenance components according to the drive operation provide by the present invention, and configurations obtaining the same objective also belong to the claimed invention.

In contrast to the related art driving module of the print head maintenance station, the driving module in the present invention can drive all maintenance components in the print head maintenance station according to a signal power source provide by a single motor only. The driving module in the present invention utilizes the cams and levers to drive different maintenance components respectively, and does not need to add more power sources. That is, the driving module in the present invention not only reduces the setup cost, but also reduces the space consumption of the print head maintenance station. Moreover, the driving module in the present invention also can provide the additional power source (e.g., the other rotating direction of the motor) so that the entire performance of the printer is greatly improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving module for driving a print head maintenance station, the print head maintenance station comprising a capper and a wiper, the driving module comprising:

a first rotating unit containing a first profile;

a second rotating unit containing a second profile;

a first supportive component coupled to the first rotating unit and the capper for driving the capper according to the first profile of the first rotating unit;

a second supportive component coupled to the second rotating unit and the wiper for driving the wiper according to the second profile of the second rotating unit;

a transfer module coupled to the first, and the second rotating units; and a motor coupled to the transfer module for providing a single power source to drive the first, and the second rotating units simultaneously to rotate through the transfer module;

wherein the transfer module includes:

a second gear set coupled to a motor, the second gear set including a first gear and a second gear;

a first shaft, the first gear and the first rotating unit being set on the first shaft; and a second shaft, the second gear and the second rotating unit being set on the second shaft.

2. The driving module of claim 1, wherein the transfer module comprising:

a first gear set coupled to the motor, the first gear set comprising a plurality of gears; and a shaft;

wherein at least a gear, the first rotating unit, and the second rotating unit are set on the shaft.

3. The driving module of claim 1, wherein the first, and the second rotating units are cams.

4. The driving module of claim 1, wherein the second profile is a radius direction surface of the second rotating unit for forcing the second supportive component to drive the wiper moving along a first direction, and a shaft direction surface of the second rotating unit containing a protruding part or a concave part for forcing the second supportive component to drive the wiper moving along a second direction.

5. The driving module of claim 4, wherein the first direction is vertical respective to the second direction.

6. The driving module of claim 1, wherein the print head maintenance station is applied in an inkjet print head.

7. A driving module for driving a print head maintenance station, the print head maintenance station comprising a capper and a wiper, the driving module comprising:

a first rotating unit containing a first profile;

a second rotating unit containing a second profile;

a first supportive component coupled to the first rotating unit and the capper for driving the capper according to the first profile of the first rotating unit;

a second supportive component coupled to the second rotating unit and the wiper for driving the wiper according to the second profile of the second rotating unit, wherein the second profile is defined by a surface of the second rotating unit having a radially varying contour for forcing the second supportive component to drive the wiper moving along a first direction, and a shaft direction surface of the second rotating unit having one of a protruding part or a concave part for forcing the second supportive component to drive the wiper moving along a second direction, and the first direction is vertical with respect to the second direction;

a transfer module coupled to the first and the second rotating units; and a motor coupled to the transfer module for providing a single power source to drive the first and the second rotating units simultaneously to rotate through the transfer module.

8. The driving module of claim 7, wherein the transfer module comprising:

a first gear set coupled to the motor, the first gear set comprising a plurality of gears; and a shaft, the shaft having at least a gear, the first rotating unit and the second rotating unit set thereon.

9. The driving module of claim 7, wherein the first and the second rotating units are cams.

10. The driving module of claim 7, wherein the print head maintenance station is applied in an inkjet print head.

* * * * *